US007241079B2

(12) United States Patent
Francis

(10) Patent No.: US 7,241,079 B2
(45) Date of Patent: Jul. 10, 2007

(54) PIER

(76) Inventor: Colin William Francis, 14 Lyly Rd., Allambie, New South Wales 2100 (AU)

( * ) Notice: Subject to any disclaimer, the term of this patent is extended or adjusted under 35 U.S.C. 154(b) by 0 days.

(21) Appl. No.: 10/525,898

(22) PCT Filed: Sep. 2, 2003

(86) PCT No.: PCT/AU03/01125

§ 371 (c)(1),
(2), (4) Date: Oct. 3, 2005

(87) PCT Pub. No.: WO2004/020744

PCT Pub. Date: Mar. 11, 2004

(65) Prior Publication Data

US 2006/0127188 A1 Jun. 15, 2006

(30) Foreign Application Priority Data

Sep. 2, 2002 (AU) ..... 2002951386
Dec. 12, 2002 (AU) ..... 2002953298

(51) Int. Cl.
*E02D 5/56* (2006.01)
*E02D 5/80* (2006.01)

(52) U.S. Cl. ..... 405/231; 52/157; 248/530

(58) Field of Classification Search ..... 405/231, 405/232, 241, 249, 252.1; 52/157, 165; 175/323; 248/156, 545, 530
See application file for complete search history.

(56) References Cited

U.S. PATENT DOCUMENTS

| | | | | |
|---|---|---|---|---|
| 3,382,937 | A * | 5/1968 | Watts | 175/323 |
| 4,279,104 | A * | 7/1981 | Classen | 52/38 |
| 4,833,846 | A * | 5/1989 | McFeetors et al. | 52/154 |
| 5,224,310 | A * | 7/1993 | Edwards et al. | 52/165 |
| 5,234,290 | A | 8/1993 | Collins | |
| 5,295,766 | A | 3/1994 | Tiikkainen | |
| 5,881,978 | A * | 3/1999 | Rust | 248/156 |
| 6,202,368 | B1 * | 3/2001 | Wallace, III | 52/157 |

FOREIGN PATENT DOCUMENTS

EP 032132 B1 3/1984

* cited by examiner

*Primary Examiner*—Sunil Singh
(74) *Attorney, Agent, or Firm*—Ladas and Parry LLP

(57) ABSTRACT

A pier (10) to be driven into a ground surface includes an auger member (11) having a shaft (12) that is rotated in a first direction to drive the auger member into the ground surface, and a compaction member (16) having a sleeve (17) surrounding a portion of the shaft. The compaction member (16) includes a compaction part (18) attached to and extending laterally outwardly of the sleeve (17). A threaded rod (23) engages the shaft (12) and is rotated to cause the compaction member (16) to move down the shaft (12) and compact the soil around the shaft.

13 Claims, 3 Drawing Sheets

PIER

TECHNICAL FIELD

The present invention relates to piers employed in the building industry but more particularly but not exclusively to a pier that is removable.

BACKGROUND OF THE INVENTION

Many applications in the construction and building industries require the use of a pier to support or maintain the position of a building structure, the structure may be permanent, temporary or may be a plant item. There is also the requirement on occasions for the pier to be removable.

Currently known piers are screwed or driven into a ground surface and are not easily retrieved. These previously known piers also suffer from the disadvantage that as the surrounding soil is disturbed they are not well suited to side loading.

The above problem is addressed by forming a hole and constructing a concrete reinforced pier. This solution is reasonably expensive, with removal of the concrete pier being costly and time consuming.

Previously known piers are described in Australian Patent Applications 72562/91, 19930/95, 69340/98, 91466/98, 74750/81, 44922/96 and 14807/97, as well as International Patent Application PCT/AU98/00782 (WO 99/14441).

OBJECT OF THE INVENTION

It is the object of the present invention to overcome or substantially ameliorate at least one of the above discussed disadvantages.

SUMMARY OF THE INVENTION

There is disclosed herein a pier to be driven into an earth surface to support a structure to be mounted thereon, said pier including:

an auger member including a shaft that is rotated in a first direction to drive the auger member into the ground surface; and a soil compaction member to compact soil around the shaft, said compaction member including a sleeve surrounding the shaft and movable relative thereto longitudinally of the shaft, and a transverse part extending laterally from and attached to the sleeve to engage the soil surrounding the shaft so that upon downward movement of the compaction member relative to the shaft soil surrounding the shaft is compacted and wherein said sleeve is operatively associated with said shaft so that rotation of said compaction member causes rotation of said shaft to thereby drive said auger member.

Preferably the pier includes a drive assembly to move the compaction member relative to the shaft.

Preferably said drive assembly includes a threaded rod threadably engaged with said shaft and operatively associated with said compaction member so that upon rotation of said rod said compaction member is caused to move relative to said shaft.

Preferably, said drive assembly includes a head attached to an upper portion of said rod and via which said rod is driven, and a nut fixed to said shaft, with said nut applying a force to said compaction member to cause said compaction member to move down said shaft.

Preferably, said drive assembly includes a head attached to an upper portion of said rod and via which said rod is driven, and a nut mounted internally of said sleeve and fixed thereto, with the rod threadably engaged with the nut so that rotation of the head causes the nut to apply force to said compaction member to cause said compaction member to move down said shaft.

Preferably, said transverse portion is a plate, with said plate being provided with surfaces that are engaged to cause rotation of said compaction member.

Preferably, said plate is provided with a plurality of apertures which provide said surfaces.

Preferably, said plate extends generally normal to said sleeve.

Preferably, said shaft is square or rectangular in transverse cross-section and said sleeve is square or rectangular in transverse cross section so as to be complimentary with respect to said shaft so as to prevent relative rotation therebetween about said rod.

Preferably, said shaft is square or rectangular in transverse cross-section and said sleeve is square or rectangular in transverse cross section so as to be complimentary with respect to said shaft.

BRIEF DESCRIPTION OF THE DRAWINGS

A preferred from of the present invention will now be described by way of example only with reference to the accompanying drawings wherein.

DETAILED DESCRIPTION OF THE PREFERRED EMBODIMENT

Figure 1:
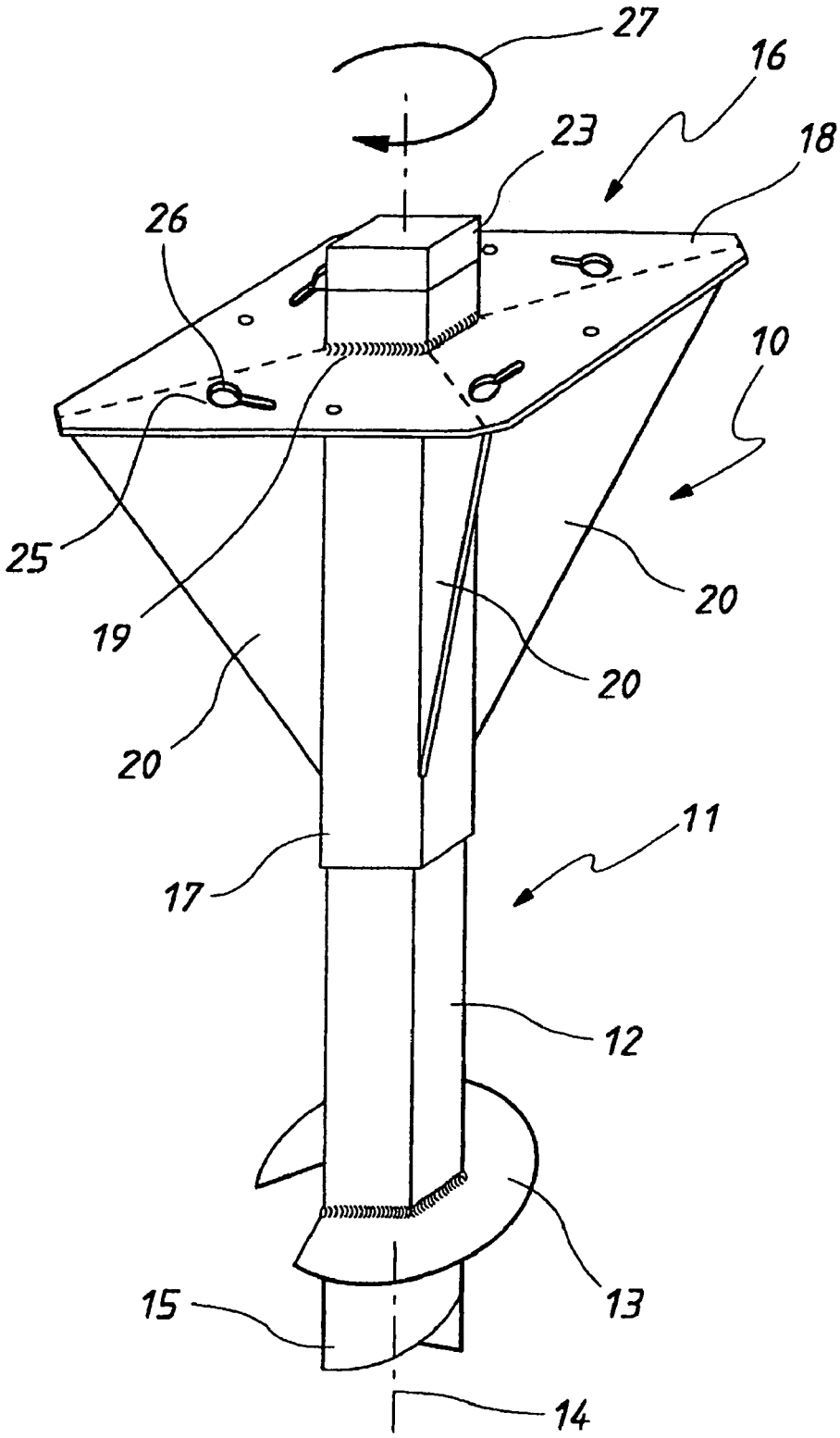
FIG. 1 is a schematic isometric view of a pier.

In the accompanying drawings there is schematically depicted a pier 10. The pier 10 includes an auger member 11 consisting of a shaft 12 to which there is fixed an auger blade 13. The auger blade 13 extends generally longitudinally and angularly with respect to the longitudinal axis 14 of the shaft 12. In this embodiment the auger blade 13 consists of a single convulsion.

The lower end of the shaft is provided with a drill bit 15 which aids penetration of the auger member 11 in a soil surface.

In this embodiment, the shaft 12 is generally square or rectangular in transverse cross-section, however it should be appreciated that the shaft 12 may have alternative configurations.

Operatively associated with the shaft 12 is a soil compaction member 16. The compaction member 16 includes a sleeve 17 that is also square or rectangular configuration so as to be complimentary with respect to the cross-section of the shaft 12. The sleeve 17 surrounds a length of the shaft 12 and is slidable therealong in a longitudinal direction relative to the axis 14.

Attached to the sleeve 17 and extending generally transverse thereof is a compaction part 18, in this embodiment the part 18 is a plate that extends generally normal to the axis 14. Preferably, the compaction part 18 is attached to the sleeve 17 by means of a weld 19.

The compaction part 18 is braced by means of a plurality of flanges or webs 20 that extend between and are attached to the compaction part 18 and sleeve 17.

In this embodiment the shaft 12 is hollow and has positioned within it a nut 21. The nut 21 is fixed to the shaft 12 so as to be stationary relative thereto. The nut 21 has a threaded longitudinal passage 22 that is threadably engaged by a threaded rod 41. The rod 41 extends upwardly from the nut 21 through the sleeve 17 to terminate at its upper end with a drive head 23. The drive head 23 bears against a projection of the compaction part 18.

Rotation of the head 23 about the longitudinal axis 14 causes movement of the compaction part 18 relative to the shaft 12 in the direction of the axis 14. In this respect, it should be appreciated that the sleeve 17 slides over the shaft 12.

The compaction part 18 includes a plurality of apertures 26 that provide surfaces 25 via which the compaction member 16 is driven about the longitudinal axis 14.

In use of the above described pier 10, the surfaces 25 are engaged so that the compaction member 15 is driven rotationally in the direction of the arrow 27. This rotation of the compaction member 16 drives the auger member 11 so that the shaft 12 enters a ground surface. At a desired depth driving of the shaft 12 ceases Thereafter the head 23 is rotatably driven so that the compaction member 16 is moved in the direction of the arrow 28. The compaction part 18 engages the soil surface and compacts the soil surface surrounding the shaft 12.

The pier 10 is removable if so required. To remove the pier 10 the head 23 is rotated in the opposite direction removing the flanges 20 from the soil layer. Thereafter the surfaces 25 are again engaged and the compaction member rotated in the opposite direction to the arrow 27 to remove the auger member 11.

Figure 2:
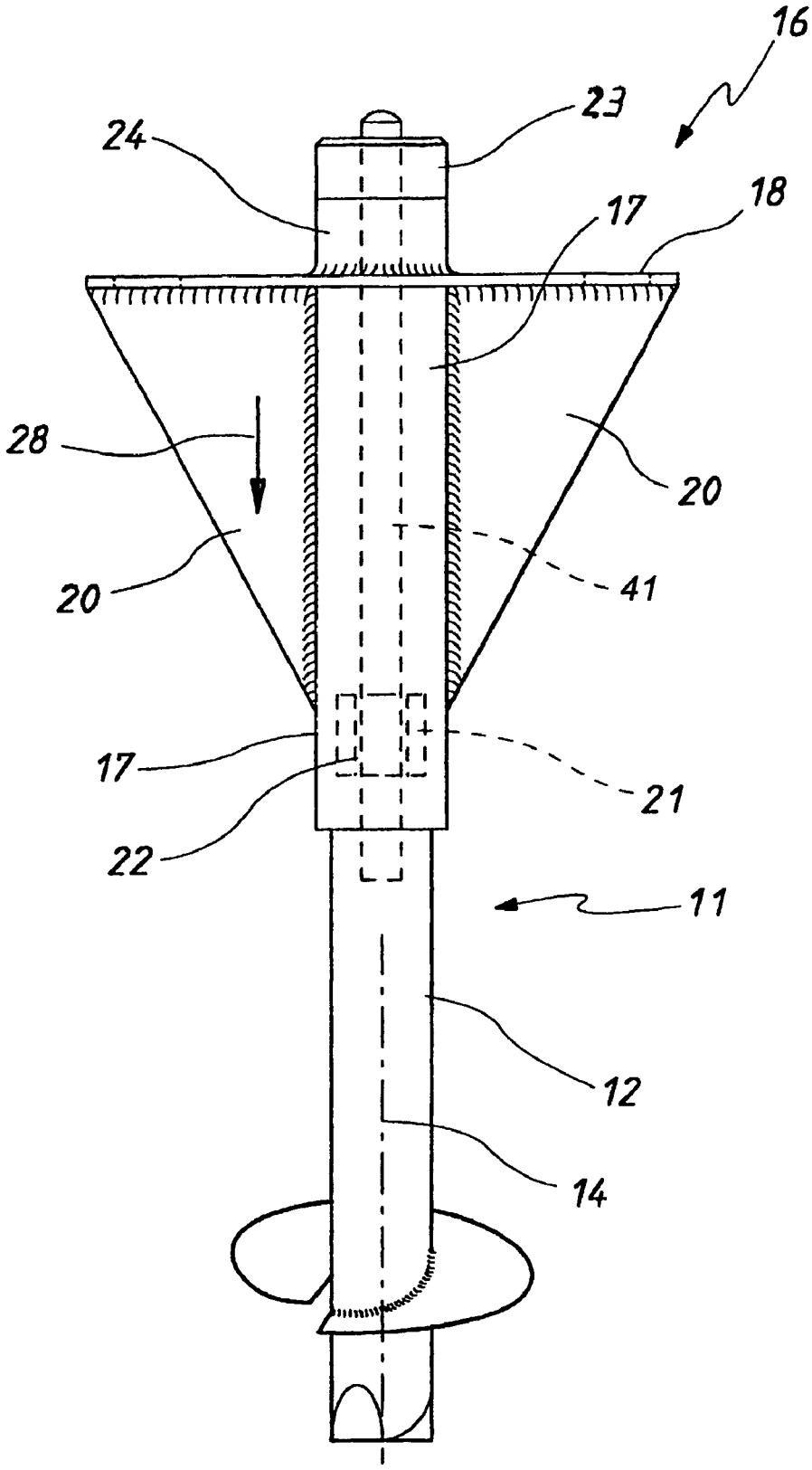
FIG. 2 is a schematic side elevation of the pier of FIG. 1.
Figure 3:
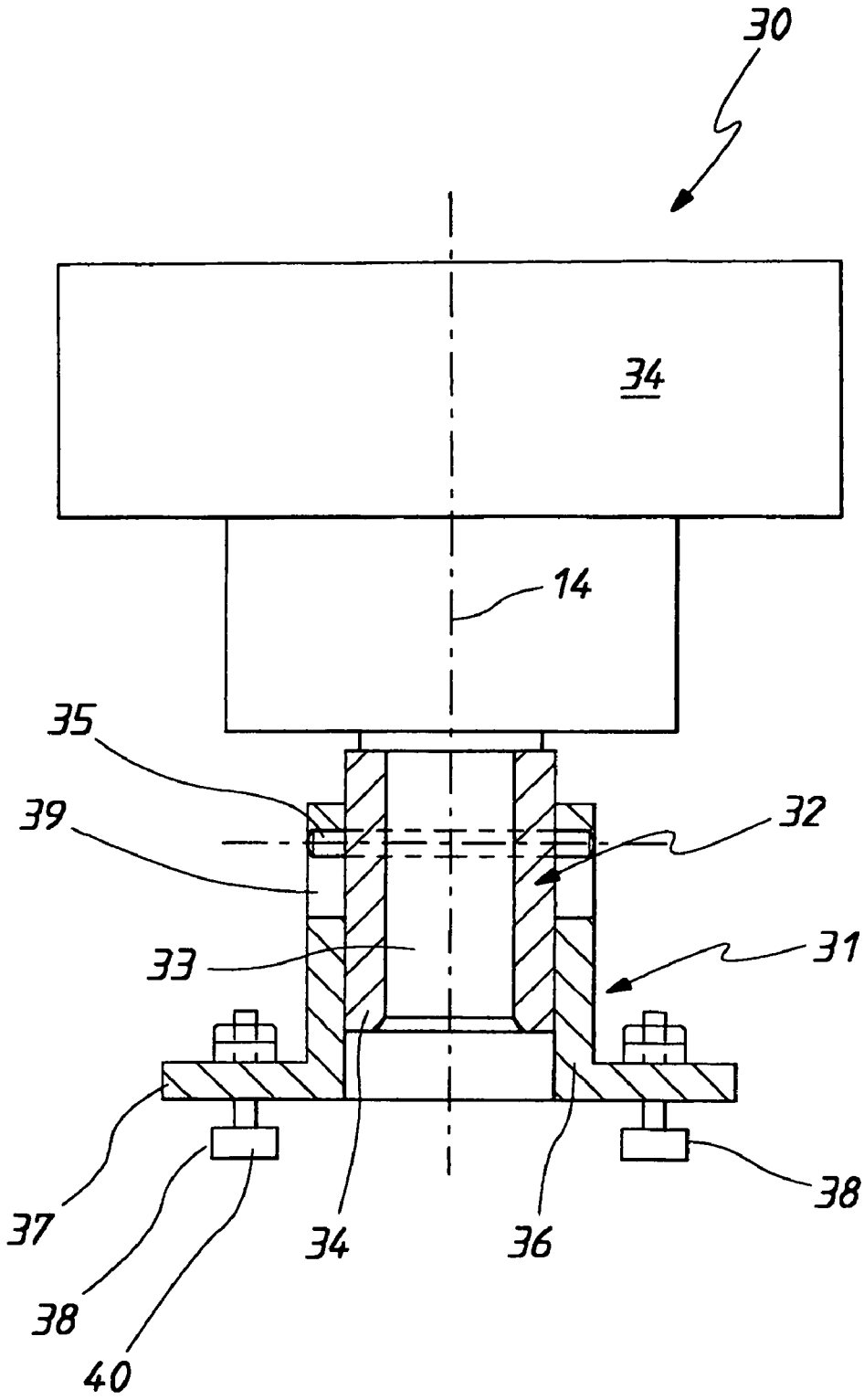
FIG. 3 is a schematic side elevation of an insertion tool to be used with the pier of FIGS. 1 and 2.

In FIG. 3 there is schematically depicted an insertion tool 30 that is one arrangement of inserting and removing the pier 10 of FIGS. 1 and 2. The insertion tool 30 includes a first drive portion 31 that is to engage the surfaces 25 to cause rotation of the compaction member 16, and a second drive portion 32 that engages the head 23. The portions 31 and 32 are both attached to a driven shaft 33 extending to a gear assembly 34 that is driven by an associated motor.

The drive portion 32 includes a socket 34 that is shaped to engage the head 23 to cause rotation thereof upon rotation of the shaft 33. The socket 34 is attached to the shaft 33 so as to rotate therewith by means of a pin 35.

The drive portion 31 includes a sleeve 36 slidably mounted on the radially outer peripheral surface of the socket 34 so as to be movable relative thereto in the direction of the axis 14. The sleeve 36 has attached to it a flange 37 having a plurality of drive pins 38 that enter the apertures 26 to engage the surfaces 25. The pin 35 extends through slots 39 formed in the sleeves 36 which slots 39 extend in the direction of the axis 14 so that the sleeve 36 is slidable in the direction of the axis 14 relative to the sleeve 36, with the sleeve 36 restricted so as to rotate with the shaft 33.

Preferably, the apertures 26 are of a "key hole" configuration and the pins 38 each provided with a head 40.

In operation of the insertion tool 30, preferably the tool 30 is attached to a mobile apparatus that has a vertically movable arm to which the tool 30 is attached. The tool 30 would be attached to the pier 10 by having the pins 38 inserted in the apertures 26 and moved relative thereto so that the pier 10 is attached to the flange 37. Thereafter the pier 10 may be lifted to an appropriate position. Thereafter the shaft 33 is rotatably driven so that the compaction member 16 drives the shaft 12. When the shaft 12 has been driven to an appropriate depth, the pins 38 are removed from within the apertures 26 and the flange 27 raised so that it is no longer operatively associated with the compaction member 16. Thereafter the socket 34 is moved into engagement with the head 23 so that rotation of the shaft 33 will then drive the rod 23 and cause the compaction part 18 to move down the shaft 12 and compact the soil.

When the pier 10 is to be removed the above steps are reversed.

The invention claimed is:

1. A pier to be driven into soil from a soil surface to support a structure to be mounted thereon, said pier including:

an auger member including a shaft that is rotated in a first direction to drive said auger member into said soil;

a soil compaction member to compact soil around said shaft, said compaction member including a sleeve surrounding said shaft and movable relative thereto longitudinally of said shaft, and a transverse part extending laterally from and attached to said sleeve to engage said soil surrounding said shaft, said sleeve being operatively associated with said shaft, whereby rotation of said compaction member causes rotation of said shaft for said drive of said auger member; and a drive assembly to move said compaction member relative to said shaft, said drive assembly including a threaded rod threadably associated with said shaft and operatively associated with said compaction member whereby, upon rotation of said rod relative to said shaft, said compaction member is caused to move longitudinally relative to said shaft to compact said soil surrounding said shaft.

2. The pier of claim 1, wherein, said drive assembly includes a head attached to an upper portion of said rod and via which said rod is driven, and a nut mounted internally of said shaft and fixed thereto, with said rod threadably engaged with said nut, whereby rotation of said head causes said head nut to apply a force to said compaction member to cause said compaction member to move down said shaft.

3. The pier of claim 1, wherein said transverse part is a plate, with said plate being provided with surfaces that are engaged to cause rotation of said compaction member.

4. The pier of claim 3, wherein said plate is provided with a plurality of apertures which provide said surfaces.

5. The pier of claim 4, wherein said plate extends generally normal to said sleeve.

6. The pier of claim 5, wherein said shaft is square or rectangular in transverse cross section and said sleeve is square or rectangular in transverse cross section whereby to be complimentary with respect to said shaft and prevent relative rotation between said shaft and sleeve.

7. A pier to be driven into an earth surface to support a structure to be mounted thereon, said pier including:

an auger member including a shaft that is rotated in a first direction to drive the auger member into the ground surface;

a soil compaction member to compact soil surrounding the shaft, the compaction member including a sleeve surrounding the shaft and movable relative thereto longitudinally of the shaft, and a transverse part extending laterally from and attached to the sleeve to engage soil surrounding the shaft, said sleeve being operatively associated with said shaft, whereby the shaft and sleeve rotate in unison; and a drive assembly including a drive member associated with said compaction member said drive member being rotated relative to said shaft and compaction member to cause longitudinal downward movement of said compaction member relative to said shaft to compact the soil surrounding the shaft.

8. The pier of claim 7, wherein said transverse part is a plate, with said plate being provided with surfaces that are engaged to cause rotation of the compaction member.

9. The pier of claim 8, wherein said surfaces are provided by apertures.

10. The pier of claim 9, wherein said plate extends generally normal to said sleeve.

11. The pier of claim 7, wherein said shaft is square or rectangular in transverse cross-section and said sleeve is of a complimentary transverse cross-section, whereby to engage said shaft and rotate said sleeve and shaft in unison.

12. The pier of claim 11, wherein said drive assembly includes a threaded rod engaged operatively associated with said compaction member, whereby upon rotation of said rod relative to said shaft said compaction member is caused to move longitudinally relative to said shaft.

13. The pier of claim 12, wherein said drive assembly further includes a nut fixed to said shaft so as to be located internally thereof, with said rod rotatably engaged with said nut, whereby upon rotation of said rod relative to said shaft said compaction member is caused to move longitudinally relative to said shaft.

* * * * *